United States Patent [19]

Matoba et al.

[11] Patent Number: 5,023,227

[45] Date of Patent: Jun. 11, 1991

[54] HEAT-SENSITIVE RECORDING MATERIAL

[75] Inventors: Gensuke Matoba; Katsuhiko Ishida; Hisashi Tani; Hiroo Hayashi, all of Hyogo, Japan

[73] Assignee: Kanzaki Paper Mfg. Co., Ltd., Tokyo, Japan

[21] Appl. No.: 453,294

[22] Filed: Dec. 22, 1989

[30] Foreign Application Priority Data

Dec. 23, 1988 [JP] Japan ..... 63-327443
Feb. 15, 1989 [JP] Japan ..... 1-36629

[51] Int. Cl.[5] ..... B41M 5/18

[52] U.S. Cl. ..... 503/214; 503/200; 503/225; 503/226

[58] Field of Search ..... 427/150–152; 503/200, 219, 225, 226

[56] References Cited

U.S. PATENT DOCUMENTS 4,047,738 9/1977 Isaac et al. ..... 428/914

*Primary Examiner*—Bruce H. Hess
*Attorney, Agent, or Firm*—Finnegan, Henderson, Farabow, Garrett and Dunner

[57] ABSTRACT

A heat-sensitive recording material comprising a support and a recording layer provided on the support, said recording layer containing a colorless or pale-colored basic dye and a color developer capable of forming a color upon application of heat, wherein a smectite clay or a combination of a synthetic hectorite clay and soap-free emulsion type binder is incorporated in at least one of layers constituting the recording material.

5 Claims, No Drawings

HEAT-SENSITIVE RECORDING MATERIAL

FIELD OF THE INVENTION

The present invention relates to a heat-sensitive recording material and more particularly to a heat-sensitive recording material with which recording can be performed always stably without being influenced by external circumstances such as humidity and recording conditions such as recording speed.

BACKGROUND OF THE INVENTION

A heat-sensitive recording material utilizing a coloring reaction between a colorless or pale-colored basic dye and an organic or inorganic color developer by contacting the dye and the color developer through application of heat is well known. A heat-sensitive recording material of this type is widely used, for example, in a facsimile, a printer and as a recording medium for use in various calculators, because it is relatively inexpensive, a recording equipment containing it is compact and further is relatively easy to maintain.

Recently, either for the adaptability to multicolorization or for the use in an overhead projector (OHP), a transparent heat-sensitive recording material (whose support is a film) and the like with which recording can be performed directly by a thermal-head have been developed.

With extention of the application form, a heat-sensitive recording material is used under various conditions that the external circumstances are varied. Thus it is required for the heat-sensitive recording material to have excellent recording suitability so that a recording image can be obtained always stably. For this reason, various improvements have been proposed.

For example, when recording is performed under low humidity conditions, the friction between a recording equipment and a recording paper produces frictional charge, thereby decreasing the suitability for passing the recording paper and causing troubles such as paper plugging (jamming), sticking of the recording paper to the recording equipment, and break-down and abnormal or wrong operation of a thermal-head and other circuits. Therefore, a method of treating the recording material with various electroconductive substances such as metal oxides, metal halides, polymeric electrolytes, surfactants and hygroscopic substances is disclosed in, for example, JP-A-57-148687, JP-A-57-156292, JP-A-57-170794 and JP-A-57-199687. (The term "JP-A" as used herein means an "unexamined published Japanese patent application".) In accordance with this method, a considerably high improvement can be obtained.

In recent years, in order to obtain a heat-sensitive recording material excellent in a degree of resolution, a film or synthetic paper has been increasingly used as a support. When such a support is used, even if various electroconductive substances as described above are used, satisfactory results cannot be always obtained. Thus still more improvements have been desired.

That is, when a film or synthetic paper is used as a support, in particular, frictional charging under low humidity conditions is marked as compared with the case that the ordinary paper is used as a support. Thus even if electroconductive substances as described above are used, no satisfactory charge preventing effect can be obtained.

It may be considered to use a metal-based electroconductive agent, but such a use is expensive and therefore not desirable because of economical reason. Besides, the metal-based electroconductive agent tends to be readily colored and, as a result, it decreases the commercial value of the obtained heat-sensitive recording material. If a large amount of such an electroconductive substance is used in order to increase the electroconductivity, problems are produced such that undesirable fogging is produced in the recording material and that coagulation likely occurs where the electroconductive substance is a polymeric electrolyte. Also, use of a large amount of a hygroscopic substance is attended by such problems that the recording material becomes tacky under high humidity conditions and that blocking between recording materials occurs.

On the other hand, from the standpoints of the use as a transparent heat-sensitive recording material (e.g., one for OHP) or the adaptability to multicolorization, it is a pressing need to develop a heat-sensitive recording material which has excellent color reproductivity and high degree of transparency.

SUMMARY OF THE INVENTION

As a result of investigations to overcome the above problems, it has been found that if a smectite clay or a combination of a synthetic hectorite clay and a soap-free emulsion type binder is chosen from various electroconductive substances and incorporated in a heat-sensitive recording material, stable recording is realized without being influenced by external circumstances from low humidity to high humidity and without being accompanied by the fog phenomenon and the blocking phenomenon even at high speed recording, and furthermore the whiteness of a recording material is kept high without reducing the opacity and thus there can be obtained a heat-sensitive recording material of high commercial value. Based on these findings, the present invention has been accomplished.

In one embodiment, the present invention relates to a heat-sensitive recording material comprising a support and a recording layer containing a colorless or pale-colored basic dye and a color developer capable of forming a color upon application of heat, wherein a smectite clay is incorporated in at least one of layers constituting the recording material.

In another embodiment, the present invention relates to a heat-sensitive recording material comprising a transparent support and a recording layer containing a colorless or pale-colored basic dye and a color developer capable of forming a color upon application of heat, wherein a synthetic hectorite clay and a soap-free emulsion type binder are incorporated in a back layer constituting the recording material.

DETAILED DESCRIPTION OF THE INVENTION

The smectite clay which is used in the present invention is represented by the following formula:

$$[(Si_{8-a}Al_a)(Mg_{6-b}).O_{20}(OH)_4]^-.M^+_{a-b}$$

wherein $M^+$ *is almost always* $Na^+$; and $a-b>O$, and includes a natural smectite clay and a synthetic smectite clay.

The synthetic hectorite clay which is used in the present invention is represented by the following formula:

$$[(Si_8(Mg_{5.34}Li_{0.66})O_{20}(OH, F)_4)]M^+_{0.66}$$

where $M^+$ is almost always $Na^+$, which is the same as in a natural hectorite clay. Examples include Laponite ® B and Laponite ® S both of which are represented by the foregoing formula and made by Laporte Industries, Ltd. Furthermore, there are Laponite ® RD, Laponite ® RDS, Laponite ® XLG, and Laponite ® XLS whose middle layer is composed entirely of a hydroxyl group, represented by the following formula:

$$[(Si_8(Mg_{5.34}Li_{0.66})O_{20}(OH)_4)]M^+_{0.66}$$

where $M^+$ is always $Na^+$, and which are made by Laporte Industries, Ltd.

The smectite clay and hectorite clay can be used in combination.

The smectite clay and/or synthetic hectorite clay has a stratified structure, where each layer of the crystal structure has a thickness of about 1 nm and forms a small plate by two-dimensional extention. Magnesium atoms present in the small plate unit are isomorphously replaced by lithium atoms which provide positive ions of lower valency, and the small plate unit is negatively charge. In a dry state, the negative charge is counterbalanced by the replaceable positive ions (ordinarily sodium ions) present in outer lattice structure of the plate surface.

When this smectite clay and/or synthetic hectorite clay is dispersed in deionized water at a concentration of from 1.5 to 2.0% by weight, the replaceable positive ions in the outer lattice structure diffuse from the surface of the small plate after ionization. Therefore, the surface of the small plate of the hectorite forms a colloidal dispersion, where small plate units which are mutually repulsed by receiving negative charges are discretely dispersed, i.e., a sol. Each of the dispersed small plates has on the whole inherent negative charges, while the edge of the small plate bears a slight local charge due to adsorption of ions from the surrounding medium. Although this phenomenon relies on the kind of ions in the solution and the concentration and pH of the medium, the edge bears positive charges since only positive ions are adsorbed. As a result, an edge-plane bond is formed which leads to the formation of a typical "Card-House" structure, i.e., a gel. The strength of the gel relies on the concentration of the smectite clay or synthetic hectorite clay. That is, lower concentrations bring about a relatively weak gel strength, since a relatively loose network of particulate chains is formed, whereas higher concentrations cause sharp increase in the strength, since the meshes of particulate chains are filled.

On the other hand, sol forming Laponite ® S, RDS or XLS contains a deflocculant (sodium pyrophosphate) so that a stable fluid dispersion can be formed at a concentration of 10%. The deflocculant is adsorbed onto the positively charged edges of the small plate to form a large amount of negatively charged ions, thereby preventing the direct formation of a gel structure which is caused by bonding between particles.

In one embodiment of the heat-sensitive recording material of the present invention, a smectite clay is incorporated in at least one of a recording layer and a support layer basically constituting the recording material and a overcoat layer, a protective layer, a back layer of the support, etc. as provided if necessary. It is particularly effective that the smectite clay is incorporated in the back layer of the support. Particularly when a film or synthetic paper is used as a support, it is desirable that the hectorite clay be incorporated in the back layer of the support.

In this case, a soap-free emulsion type binder as described later can be incorporated in the back layer of the support to thereby effectively avoid the blocking from occurrence.

The amount of the smectite clay used is determined appropriately depending on the type of the support, the constitution of the recording layer and further depending on the state of the layer in which the smectite clay is to be incorporated and so forth. Thus it is not critical. In general, the smectite clay is incorporated in an amount of from about 0.1 to 5 $g/m^2$ and preferably from about 0.2 to 2 $g/m^2$.

Up to the concentration of about 10% in water, the smectite clay can be made into a homogeneous sol or gel, which, when applied onto plastic sheets and dried thereafter, forms a good film having excellent electroconductivity.

For the improvement of film-homogeneity, adhesion and coatability of the coating, the coating composition may be admixed with surfactants, watersoluble resins, etc.

Examples of the surfactants which are usable are dimethylalkyllaurylbetaines, dimethylalkyl(palm-)betaines, alkylglycines, octadecyltrimethylammonium chloride, dodecyltrimethylammonium chloride, hexadecyltrimethylammonium chloride, behenyltrimethylammonium chloride, polyoxyethylene distearate, glycidyl methacrylate, polyethylene glycol monomethanol, and quaternary salts of alkyl(tallow)imidazoline.

Examples of the water-soluble resins which are usable are sodium polyacrylate, esters of polyacrylic acids and their copolymers, polymers and copolymers of sodium maleate, CMC, PVA, starch, sodium alginate, and polymers having a sodium sulfonato group.

In another embodiment of the heat-sensitive recording material of the present invention, a synthetic hectorite clay and a soap-free emulsion type binder are incorporated in a back layer constituting the recording material. Examples of the soap-free emulsion type binder which is used in the present invention include polyesters, polyurethanes, vinyl acetate copolymers, urethane copolymers, acrylic copolymers, and epoxy copolymers.

As the method of synthesis of these soap-free emulsion type binders, there are generally known the following methods.

(1) A method in which a hydrophilic monomer is copolymerized with a compound having an ion group.

(2) A method in which a hydrophilic monomer is copolymerized with a hydrophilic compound having no ion group, such as polyethylene glycol.

(3) A method in which a polymerization initiator having an ion group is used. As the method for producing a soap-free emulsion of polyurethane, there is known a method for producing a polyurethane ammonium salt by introducing an ion center into a polymer to convert the polymer into a self emulsion type, as disclosed in JP-B-43-9076. (The term "JP-B" as used herein means an "examined Japanese patent publication".)

Specific examples of the soap-free emulsion type binder include Hydran ® AP-40 (a trade name of Dainippon Ink and Chemicals, Inc.) and LA-441Al (a trade name of Hoechst Gosei Co., Ltd.).

The proportion of the synthetic hectorite clay to the soap-free emulsion type binder which are used in the present invention is not particularly limited, but usually, the latter is used in an amount of from about 5 to 100 parts by weight per 100 parts by weight of the former.

The amount of the synthetic hectorite clay is appropriately adjusted depending on the type of the transparent support and the constitution of the recording layer and is not particularly limited. However, the synthetic hectorite clay is usually used in an amount of from about 0.1 to 5 $g/m^2$ and preferably from about 0.2 to 2 $g/m^2$.

As the transparent support, films composed of, e.g., polyesters, polypropylene, polyimides, polyamides, or cellulose acetate are employable. A suitable thickness of the support is from 30 to 250 $\mu m$.

In the present invention, in order to improve the adhesion between the support and the recording layer or back layer, the support can be previously subjected to a corona discharge treatment or provided with a subbing layer. As the subbing layer, synthetic resins for anchor coating, gelatin, nitrocellulose, etc. can be used. A suitable coverage of the subbing layer is from 0.2 to 2.0 $g/m^2$ from the standpoints of adhesion and production cost.

For the improvement of film-homogeneity, adhesion and coatability of the coating, the coating composition for the back layer may be admixed with lubricants, pigments, etc.

Examples of the lubricant which can be used include emulsions of higher fatty acids such as zinc stearate and calcium stearate, paraffin waxes, and silicone rubber emulsions. The lubricant is added in a proportion of from 0.5 to 20% by weight, preferably from 1 to 10% by weight, of the whole of the back layer.

Examples of the pigment which can be used include colloidal silica and kaolin. The pigment is added in a proportion of from 5 to 50% by weight, preferably from 10 to 30% by weight, of the whole of the back layer.

As the basic dye to be incorporated in the recording layer of the present invention, various known colorless or pale-colored basic dyes can be used. Examples are triarylmethane-based dyes such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, and 3-p-dimethylaminophenyl-3-(1-methylpyrrole-3-yl)-6-dimethylaminophthalide; diphenylmethane-based dyes such as 4,4'-bisdimethylaminobenzhydryl-benzylether, N-halophenyl-leucoauramines, and N-2,4,5-trichlorophenyl-leucoauramine; thiazine-based dyes such as benzoyl-leucomethyleneblue and p-nitrobenzoyl-leucomethyleneblue; spiro-based dyes such as 3-methyl-spiro-dinaphthopyran, 3-ethyl-spiro-dinaphthapyran, 3-phenyl-spiro-dinaphthopyran, 3-benzyl-spiro-dinaphthopyran, 3-methylnaphtho-(6'-methoxybenzo)spiropyran, and 3-propyl-spiro-dibenzopyran; lactam-based dyes such as rhodamine-B-anilinolactam, rhodamine(p-nitroanilino)lactam and rhodamine(o-chloroanilino)-lactam; and fluoran-based dyes such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)fluoran, 3-diethylamino-7-N-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxyphenylamino)fluoran, 3-(N-cyclohexyl-N-methylamino)-6-methyl-7-phenylaminofluoran, 3-pyrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-diethylamino-7-(o-fluorophenylamino)fluoran, 3-dibutylamino-7-(o-fluorophenylamino)fluoran, 3-(N-methyl-N-n-amyl)amino-6-methyl-7-phenylaminofluoran, 3-(N-ethyl-N-n-amyl)amino-6-methyl-7-phenylaminofluoran, 3-(N-ethyl-N-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, and 3-(N-ethyl-N-$\beta$-ethylhexyl)amino-6-methyl-7-phenylaminofluoran. These basic dyes can be used as mixtures of two or more thereof if necessary.

As the color developer, inorganic or organic acidic substances forming a color on contacting with the above basic dyes can be used. Examples are phenolic compounds such as 4-tert-butylphenol, $\alpha$-naphthol, $\beta$-naphthol, 4-acetylphenol, 4-phenylphenol, hydroquinone, 4,4'-isopropylidenediphenol(bisphenol A), 2,2'-methylenebis(4-chlorophenol), 4,4'-cyclohexylidenediphenol, 1,3-di[2-(4-hydroxyphenyl)-2-propyl]benzene, 4,4'-dihydroxydiphenyl sulfide, bis(3-allyl-4-hydroxyphenyl)sulfone, 4-hydroxyphenyl-4'-iso-propyloxyphenylsulfone, hydroquinone monobenzylether, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenethyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenyl 4-hydroxybenzoate, p-chlorobenzyl 4-hydroxybenzoate, p-methoxybenzyl 4-hydroxybenzoate, novolak type phenol resins, and phenol polymers; aromatic carboxylic acids such as benzoic acid, p-tert-butylbenzoic acid, trichlorobenzoic acid, terephthalic acid, 3-sec-butyl-4-hydroxybenzoic acid, 3-cycylohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicyclic acid, 3-($\alpha$-methylbenzyl)-salicylic acid, 3-chloro-5-($\alpha$-methylbenzyl)salicylic acid, 3,5-di-tert-butylsalicylic acid, 3-phenyl-5-($\alpha$,$\alpha$-dimethylbenzyl)-salicylic acid, and 3,5-di-$\alpha$-methylbenzylsalicylic acid; and salts of the above phenolic compounds or aromatic carboxylic acids with polyvalent metals (e.g., zinc, magnesium, aluminum, calcium, titanium, manganese, tin and nickel). These color developers can also be used as mixtures of two or more thereof if necessary.

The ratio of the basic dye to the color developer is not critical and can be determined appropriately depending on the type of the basic dye or color developer. In general, the color developer is used in an amount of from 1 to 20 parts by weight, preferably from 2 to 10 parts by weight, per part by weight of the basic dye.

A coating composition containing the above substances is prepared, for example, by dispersing the dye and the color developer, in combination with each other or independently, in water by the use of a dispersing or grinding equipment, e.g., a ball mill, an attritor, and a sand mill.

In the coating composition, usually as a binder, starches, hydroxyethyl cellulose, methyl cellulose, carboxymethyl cellulose, gelatin, casein, gum arabic, polyvinyl alcohol, acetoacetyl group-modified polyvinyl alcohol, diisobutylene-maleic anhydride copolymer salts, styrene-maleic anhydride copolymer salts, ethylene-acrylic acid copolymer salts, styrene-acrylic acid copolymer salts, styrene-butadiene copolymer emulsions, a urea resin, a melamine resin, an amide resin and the like are used in a proportion of from 2 to 40% by weight, preferably from 5 to 25% by weight based on the total weight of solids.

To the coating composition, if necessary, various additives can be added. For example, dispersing agents such as sodium dioctylsulfosuccinate, sodium dodecylbenzenesulfonate, sodium salts of lauryl alcohol sulfuric acid esters, and fatty acid metal salts, ultraviolet absorbing agents such as benzophenone-based compounds, and defoaming agents, fluorescent dyes, coloring dyes and the like can be added appropriately.

In addition, if necessary, zinc stearate, calcium stearate, waxes such as polyethylene wax, carnauba wax, paraffin wax, and ester wax, fatty acid amides such as stearic acid amide, stearic acid methylenebisamide, palmitic acid amide, and coconut fatty acid amide, hindered phenols such as 2,2'-methylene-bis(4-methyl-6-tert-butylphenol) and 1,1,3-tris(2-methyl-4-hydroxy-5-tert-butylphenyl)butane, ultraviolet absorbing agents such as 2-(2'-hydroxy-5'-methylphenyl)benzotriazole and 2-hydroxy-4-benzyloxybenzophenone, 1,2-di(3-methylphenoxy)ethane, 1,2-diphenoxyethane, 1-phenoxy-2-(4-methylphenoxy)ethane, esters such as dimethyl terephthalate, dibutyl terephthalate, dibenzyl terephthalate, p-benzyl-biphenyl, 1,4-dimethoxynaphthalene, 1,4-diethoxynaphthalene, esters such as phenyl 1-hydroxy-2-naphthoate, and various known heat fusible substances, inorganic pigments such as kaolin, clay, talc, calcium carbonate, calcined clay, titanium oxide, diatomaceous earth, fine anhydrous silica, and activated clay can be added.

Moreover, usual electroconductive substances can be added within the range that does not deteriorate the desired effects of the present invention.

In the heat-sensitive recording material of the present invention, a method of forming a recording layer is not critical. For example, the recording layer is formed by applying the coating composition by techniques such as air knife coating and blade coating. The coating weight of the coating composition is not critical. Usually the coating weight of the coating composition is controlled within the range of from about 2 to 12 g/m$^2$, preferably from about 3 to 10 g/m$^2$ (as dry weight).

On the recording layer can be provided an overcoat layer for the purpose of e.g., protecting the recording layer. If necessary, a protective layer can be provided on the back surface of the support. In addition, various known techniques in the field of preparation of heat-sensitive recording materials, such as providing an undercoating interlayer on the support, applying an adhesive treatment to the back side of the recording material, and fabricating into adhesive labels can be applied if necessary.

The present invention is described in greater detail with reference to the following examples. All parts and percents (%) are by weight unless otherwise indicated.

EXAMPLE 1

(1) Preparation of Dispersion A

| | |
|---|---|
| 3-(N-Ethyl-N-isoamylamino)-6-methyl-7-phenylaminofluoran | 10 parts |
| Dibenzyl terephthalate | 20 parts |
| 5% Aqueous solution of methyl cellulose | 20 parts |
| Water | 40 parts |

This composition was ground by the use of a sand mill to an average particle diameter of 3 μm.

(2) Preparation of Dispersion B

| | |
|---|---|
| 4,4'-Isopropylidenediphenol | 30 parts |
| 5% Aqueous solution of methyl cellulose | 40 parts |
| Water | 20 parts |

This composition was ground by the use of a sand mill to an average particle diameter of 3 μm.

(3) Formation of Recording Layer 90 parts of Dispersion A, 90 parts of Dispersion B, 30 parts of fine-grained anhydrous silica (trade name: Mizukasil ® P-527, average particle diameter: 1.8 μm, oil absorption: 180 ml/100 g, manufactured by Mizusawa Kagaku Co., Ltd.), 300 parts of a 10% aqueous polyvinyl alcohol solution and 28 parts of water were mixed and stirred to obtain a coating composition. The coating composition thus obtained was applied onto a synthetic paper (trade name: Yupo ® FPG manufactured by Oji-Yuka Synthetic Paper Co., Ltd.) in such an amount that the coating weight after drying was 5 g/m$^2$ and dried and, thereafter, was subjected to super-calendering to obtain a heat-sensitive recording material.

(4) Formation of Back Layer

| | |
|---|---|
| Synthetic smectite clay (trade name: Sumecton ® SA-1, manufactured by Kunimine Industries Co., Ltd.) | 5 parts |
| Soap-free emulsion (trade name: Hydran ® AP-40, manufactured by Dainippon Ink and Chemicals, Inc.) | 2 parts |
| Water | 98 parts |

This composition was mixed and stirred to obtain a coating composition. The coating composition was applied onto the back side of the support in such an amount that the coating weight after drying was 1 g/m$^2$ and then dried to obtain a heat-sensitive recording material of the present invention.

EXAMPLE 2

A heat-sensitive recording material was produced in the same manner as in Example 1, except that in the formation of the back layer, a natural smectite clay (trade name: VEEGUM ®, manufactured by Vanderbilt Inc.) was used in place of the synthetic smectite clay (trade name: Sumecton ® SA-1, manufactured by Kunimine Industries Co., Ltd.).

EXAMPLE 3

A heat-sensitive recording material was produced in the same manner as in Example 1, except that in the formation of the back layer, a smectite clay and a surfactant were mixed in the following amounts and stirred to obtain a coating composition.

| | |
|---|---|
| Natural smectite clay (trade name: VEEGUM ®, manufactured by Vanderbilt Inc.) | 2 parts |
| Surfactant (trade name: Chemistat ® 6120, manufactured by Sanyo Chemical Industries, Ltd.) | 6 parts |
| Water | 100 parts |

EXAMPLE 4

Up to the formation of the recording layer, the same procedure as in Example 1 was adopted. In order to produce a heat-sensitive recording material with an overcoat layer, a coating composition was further applied onto the foregoing recording layer so that the coating weight after the application and drying thereof was 1 g/m$^2$, the coating composition being obtained by mixing and stirring the following components:

| | |
|---|---|
| Synthetic smectite clay (trade name: Sumecton ® SA-1) | 2 parts |
| Polyvinyl alcohol (trade name: Kuraray ® Poval-117, manufactured by Kuraray Co., Ltd.) | 5 parts |
| Water | 93 parts |

In this case, no back layer was formed.

COMPARATIVE EXAMPLES 1 AND 2

Heat-sensitive recording materials were produced in the same manner as in Example 1, except that in the formation of the back layer, electroconductive zinc oxide (electroconductive zinc oxide "23-K", manufactured by Hakusui Kagaku Co., Ltd.) (Comparative Example 1) and an anionic polymeric electroconductive agent (Comparative Example 2) were used in place of the synthetic smectite clay (trade name: Sumecton ® SA-1).

COMPARATIVE EXAMPLE 3

A heat-sensitive recording material was produced in the same manner as in Example 1, except that in the formation of the back layer, a coating composition which had been obtained by mixing 20 parts of a surfactant (trade name: Chemistat ® 6120, manufactured by Sanyo Chemical Industries, Ltd.) and 100 parts of water and stirring the mixture was used.

COMPARATIVE EXAMPLE 4

A heat-sensitive recording material was produced in the same manner as in Example 4, except that in the formation of the overcoat layer, use was made of a coating composition which had been obtained by mixing and stirring the following components:

| | |
|---|---|
| Polyvinyl alcohol (trade name: Kuraray ® Poval-117, manufactured by Kuraray Co., Ltd.) | 5 parts |
| Water | 95 parts |

The eight heat-sensitive recording materials thus obtained were tested by the methods described below. The results are shown in Table 1.

Measurement of Surface Resistance

The surface resistance of the back layer (the surface layer, i.e., the overcoat layer for Example 4 and Comparative Example 4) of the recording material was measured under both ordinary humidity and low humidity conditions by the use of a Teraohmmeter (Model VE-30 manufactured by Kawaguchi Denki Co., Ltd.). The results are shown in Table 1.

Recording suitability

Suitability for passing and discharging sheet was evaluated by recording under both ordinary humidity and low humidity conditions by the use of a video printer (SCT-P-60 manufactured by Mitsubishi Electric Corporation), and the recording density of the recorded image was measured with a Macbeth Densitometer (Model RD-914 of Macbeth Corp.). The results are shown in Table 1. The rating for evaluation of suitability for passing and discharging sheet was as follows:

: No trouble in passing and discharging sheet due to frictional charging

: Good, practically no trouble x: Sticking trouble of the recording material to the video printer is caused by frictional charging.

TABLE 1

| Run No. | Surface Resistance (Ω) Ordinary Humidity | Surface Resistance (Ω) Low Humidity | Recording Density Ordinary Humidity | Recording Density Low Humidity | Passing/Discharging Sheet Ordinary Humidity | Passing/Discharging Sheet Low Humidity |
|---|---|---|---|---|---|---|
| Example 1 | $4.2\times10^{8}$ | $3.1\times10^{9}$ | 1.23 | 1.23 | ⊙ | ⊙ |
| Example 2 | $5.6\times10^{8}$ | $7.2\times10^{9}$ | 1.26 | 1.26 | ⊙ | ⊙ |
| Example 3 | $7.3\times10^{8}$ | $2.1\times10^{10}$ | 1.24 | 1.24 | ⊙ | ⊙ |
| Example 4 | $2.5\times10^{9}$ | $9.3\times10^{9}$ | 1.25 | 1.25 | ⊙ | ○ |
| Comparative Example 1 | $1.1\times10^{12}$ | $\geqq10^{13}$ | 1.26 | 1.26 | X | X |
| Example 2 | $9.4\times10^{6}$ | $1.3\times10^{10}$ | 1.25 | 1.25 | ⊙ | X |
| Example 3 | $7.6\times10^{8}$ | $1.4\times10^{11}$ | 1.24 | 1.24 | ○ | X |
| Example 4 | $1.3\times10^{9}$ | $1.5\times10^{12}$ | 1.25 | 1.25 | ○ | X |

[Note]:
Ordinary Humidity: 20° C, 60% RH
Low Humidity: 20° C, 20% RH

As apparent from the results of Table 1, all the recording materials of the present invention were not influenced by changes in external circumstances and had stable recording suitability.

EXAMPLE 5

(1) Preparation of Dispersion A

| | |
|---|---|
| 3-(N-Ethyl-N-isoamylamino)-6-methyl-7-phenylaminofluoran | 15 parts |
| Dibenzyl terephthalate | 30 parts |
| 5% Aqueous solution of methyl cellulose | 20 parts |
| Water | 40 parts |

This composition was ground by the use of a sand mill to an average particle diameter of 3 μm.

(2) Preparation of Dispersion B

| | |
|---|---|
| 4,4'-Isopropylidenediphenol | 25 parts |
| 5% Aqueous solution of methyl cellulose | 40 parts |
| Water | 20 parts |

This composition was ground by the use of a sand mill to an average particle diameter of 3 μm.

(3) Formation of Recording Layer 90 parts of Dispersion A, 90 parts of Dispersion B, 30 parts of fine-grained anhydrous silica (trade name: Mizukasil ® p-527, average particle diameter: 1.8 μm, oil absorption: 180 ml/100 g, manufactured by Mizusawa Kagaku Co., Ltd.), 300 parts of a 10% aqueous polyvinyl alcohol solution and 28 parts of water were mixed and stirred to obtain a coating composition. The coating composition thus obtained was applied onto a 50 μm thick polyethylene terephthalate film, the both surfaces of which had been subjected to a corona discharge treatment, in such an amount that the coating weight after drying was 5 g/m$^2$ to obtain a heat-sensitive recording layer.

(4) Formation of Overcoat Layer

| | |
|---|---|
| Water | 30 parts |
| 60% Water dispersion of kaolin | 10 parts |
| 30% Water dispersion of zinc stearate | 3 parts |
| 10% Water dispersion of polyvinyl alcohol (trade name: Kuray ® PVA-117, manufactured by Kuraray Co., Ltd.) | 30 parts |

This composition was mixed and stirred to obtain a coating composition. The coating composition was applied onto the recording layer in such an amount of the coating weight after drying was 2 g/m$^2$ and then dried to obtain an overcoat layer.

(5) Formation of Back Layer

| | |
|---|---|
| Water | 90 parts |
| Synthetic hectorite clay (trade name: Laponite ® S, manufactured by Laporte Industries, Ltd.) | 10 parts |
| Soap-free emulsion (trade name: Hydran ® AP-40, manufactured by Dainippon Ink and Chemicals, Inc., solids content: 23%) | 30 parts |

This composition was mixed and stirred to obtain a coating composition. The coating composition was applied onto the back side of the support in such an amount that the coating weight after drying was 1 g/m$^2$ and then dried to obtain a heat-sensitive recording material of the present invention.

EXAMPLE 6

A heat-sensitive recording material was produced in the same manner as in Example 5, except that in the formation of the back layer, a synthetic hectorite clay (trade name: Laponite ® RDS, manufactured by Laporte Industries, Ltd.) was used in place of the synthetic hectorite clay (trade name: Laponite ® S, manufactured by Laporte Industries, Ltd.).

EXAMPLE 7

A heat-sensitive recording material was produced in the same manner as in Example 5, except that in the formation of the back layer, the respective components were mixed in the following amounts and stirred to obtain a coating composition.

| | |
|---|---|
| Water | 90 parts |
| Synthetic hectorite clay (trade name: Laponite ® S) | 10 parts |
| Colloidal silica (trade name: Adelite ® AT-40, manufactured by Asahi Denka Kogyo K.K., solids content: 40%) | 10 parts |
| Soap-free emulsion (trade name: LA-440Al, manufactured by Hoechst Gosei Co., Ltd., solids content: 30%) | 6 parts |

COMPARATIVE EXAMPLES 5 AND 6

Heat-sensitive recording materials were produced in the same manner as in Example 5, except that in the formation of the back layer, 10 parts of electroconductive tin oxide (electroconductive powder "T-1", manufactured by Mitsubishi Metal Corporation) (Comparative Example 5) and 25 parts of an anionic polymeric electroconductive agent (trade name: Poise ® 520, manufactured by Kao Corporation, solids content: 40%) (Comparative Example 6) were used in place of the synthetic hectorite clay.

COMPARATIVE EXAMPLE 7

A heat-sensitive recording material was produced in the same manner as in Example 5, except that the formation of the back layer, 55 parts of an emulsifier-containing emulsion type binder (trade name: Bondik ® 1320NS, manufactured by Dainippon Ink and Chemicals, Inc., solids content: 40%) were used in place of the soap-free emulsion (trade name: Hydran ® AP-40).

The six heat-sensitive recording materials thus obtained were tested by the methods described below. The results are shown in Table 2.

Measurement of Surface Resistance

The surface resistance of the back layer of the recording material was measured under both ordinary humidity and low humidity conditions by the use of a Teraohmmeter (Model VE-30 manufactured by Kawaguchi Denki Co., Ltd.). The results are shown in Table 2.

Recording Suitability

Suitability for passing and discharging sheet was evaluated by recording under both ordinary humidity and low humidity conditions by the use of a video printer (SCT-P-60 manufactured by Mitsubishi Electric Corporation), and the recording density of the recorded image was measured with a Macbeth Densitometer image was measured with a Macbeth Densitometer (Model RD-914 of Macbeth Corp.). The results are shown in Table 2. The rating for evaluation of suitability for passing and discharging sheet was as follows:

: No trouble in passing and discharging sheet due to frictional charging

: Good, practically no trouble x: Sticking trouble of the recording material to the video printer is caused by frictional charging.

Blocking

Blocking was evaluated by storing samples wound in a roll form at a temperature of 50° C. and at a humidity of 90% RH for 24 hours to thereby observe the presence of adhesion trouble. The rating for blocking was as flllows.

: No adhesion trouble x: Adhesion trouble occurred.

TABLE 2

| Run No. | Surface Resistance (Ω) Ordinary Humidity | Surface Resistance (Ω) Low Humidity | Recording Density Ordinary Humidity | Recording Density Low Humidity | Passing/Discharging Sheet Ordinary Humidity | Passing/Discharging Sheet Low Humidity | Blocking |
|---|---|---|---|---|---|---|---|
| Example 5 | $4.7\times10^{7}$ | $2.1\times10^{8}$ | 1.32 | 1.30 | ⊙ | ⊙ | ○ |
| Example 6 | $3.2\times10^{7}$ | $8.5\times10^{7}$ | 1.31 | 1.32 | ⊙ | ⊙ | ○ |
| Example 7 | $2.8\times10^{8}$ | $7.6\times10^{8}$ | 1.34 | 1.31 | ⊙ | ⊙ | ○ |
| Comparative Example 5 | $3.2\times10^{8}$ | $4.3\times10^{8}$ | 1.32 | 1.32 | ○ | ⊙ | x |
| Example 6 | $7.6\times10^{9}$ | $5.3\times10^{12}$ | 1.32 | 1.33 | ⊙ | x | x |
| Example 7 | $4.2\times10^{7}$ | $2.5\times10^{8}$ | 1.33 | 1.32 | ⊙ | ⊙ | x |

[Note 1]
Ordinary Humidity: 20° C, 60% RH
Low Humidity: 20° C, 20% RH

As apparent from the results of Table 2, all the recording materials of the present invention were not influenced by changes in external circumstances and had stable recording suitability. Further, the recording materials of the present invention did not cause blocking even when they were stored in a roll form.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording material comprising a support and a recording layer provided on the support, said recording layer containing a colorless or pale-colored basic dye and a color developer capable of forming a color upon application of heat, wherein a smectite clay is incorporated in at least one of layers constituting the recording material.

2. The recording material as claimed in claim 1, wherein said support has a back layer and wherein the smectite clay is incorporated in the back layer of the support.

3. The recording material as claimed in claim 1, wherein the support is a film or a synthetic paper.

4. The recording material as claimed in claim 1, wherein said support has a back layer and wherein a soap-free emulsion binder is incorporated in the back layer of the support.

5. A heat-sensitive recording material comprising a transparent support and a recording layer provided on the support, said recording layer containing a colorless or pale-colored basic dye and a color developer capable of forming a color upon application of heat, wherein a synthetic hectorite clay and a soap-free emulsion binder are incorporated in a back layer of said support.

* * * * *